US006195945B1

(12) United States Patent
McGarry et al.

(10) Patent No.: US 6,195,945 B1
(45) Date of Patent: Mar. 6, 2001

(54) PREFABRICATED ARCH STRUCTURE

(75) Inventors: Thomas E. McGarry; Edward McGarry, both of Thousand Oaks, CA (US)

(73) Assignee: W. Frank Little, Jr., Magnolia, TX (US)

( * ) Notice: Subject to any disclaimer, the term of this patent is extended or adjusted under 35 U.S.C. 154(b) by 0 days.

(21) Appl. No.: 09/199,383

(22) Filed: Nov. 25, 1998

(51) Int. Cl.[7] ..... E04B 1/32

(52) U.S. Cl. ..... 52/88; 52/85; 52/204.2; 52/211; 52/213; D25/60

(58) Field of Search ..... 52/85–89, 204.1, 52/211, 213, 254, 255, 204.53, 204.54, 312, 212, 216, 204.2; 405/124–126, 132, 134; D25/60

(56) References Cited

U.S. PATENT DOCUMENTS

| | | | | |
|---|---|---|---|---|
| 3,008,273 | * | 11/1961 | Widin . | |
| 4,400,917 | * | 8/1983 | Massaro et al. | 52/86 |
| 4,601,138 | * | 7/1986 | Hampton | 52/86 |
| 4,665,666 | * | 5/1987 | Hampton | 52/86 |
| 5,572,834 | * | 11/1996 | Lilly | 52/85 |

* cited by examiner

*Primary Examiner*—Carl D. Friedman
*Assistant Examiner*—Yvonne M. Horton
(74) *Attorney, Agent, or Firm*—Alton W. Payne

(57) ABSTRACT

A new prefabricated arch structure for aiding the construction of an archway. The inventive device includes a base wall with a pair of spaced apart side walls outwardly extending from the inner surface of the base wall. Each side wall is generally triangular and has a vertex corner, and a pair side edges extending from the vertex corner towards the ends of the base wall.

11 Claims, 3 Drawing Sheets

PREFABRICATED ARCH STRUCTURE

BACKGROUND OF THE INVENTION

1. Field of the Invention

The present invention relates to prefabricated arch structures and more particularly pertains to a new prefabricated arch structure for aiding the construction of an archway.

2. Description of the Prior Art

The use of prefabricated arch structures is known in the prior art. More specifically, prefabricated arch structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art prefabricated arch structures include U.S. Pat. No. 4,665,666; U.S. Pat. No. 4,601,138; U.S. Pat. No. Des. 361,845; U.S. Pat. No. 4,301,632; U.S. Pat. No. 4,283,894; and U.S. Pat. No. 4,894,962.

While these devices fulfill their respective, particular objectives and requirements, the aforementioned patents do not disclose a new prefabricated arch structure. The inventive device includes a base wall with a pair of spaced apart side walls outwardly extending from the inner surface of the base wall. Each side wall is generally triangular and has a vertex corner, and a pair side edges extending from the vertex corner towards the ends of the base wall.

In these respects, the prefabricated arch structure according to the present invention substantially departs from the conventional concepts and designs of the prior art, and in so doing provides an apparatus primarily developed for the purpose of aiding the construction of an archway.

SUMMARY OF THE INVENTION

In view of the foregoing disadvantages inherent in the known types of prefabricated arch structures now present in the prior art, the present invention provides a new prefabricated arch structure construction wherein the same can be utilized for aiding the construction of an archway.

The general purpose of the present invention, which will be described subsequently in greater detail, is to provide a new prefabricated arch structure apparatus and method which has many of the advantages of the prefabricated arch structures mentioned heretofore and many novel features that result in a new prefabricated arch structure which is not anticipated, rendered obvious, suggested, or even implied by any of the prior art prefabricated arch structures, either alone or in any combination thereof.

To attain this, the present invention generally comprises a base wall with a pair of spaced apart side walls outwardly extending from the inner surface of the base wall. Each side wall is generally triangular and has a vertex corner, and a pair side edges extending from the vertex corner towards the ends of the base wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new prefabricated arch structure apparatus and method which has many of the advantages of the prefabricated arch structures mentioned heretofore and many novel features that result in a new prefabricated arch structure which is not anticipated, rendered obvious, suggested, or even implied by any of the prior art prefabricated arch structures, either alone or in any combination thereof.

It is another object of the present invention to provide a new prefabricated arch structure which may be easily and efficiently manufactured and marketed.

It is a further object of the present invention to provide a new prefabricated arch structure which is of a durable and reliable construction.

An even further object of the present invention is to provide a new prefabricated arch structure which is susceptible of a low cost of manufacture with regard to both materials and labor, and which accordingly is then susceptible of low prices of sale to the consuming public, thereby making such prefabricated arch structure economically available to the buying public.

Still yet another object of the present invention is to provide a new prefabricated arch structure which provides in the apparatuses and methods of the prior art some of the advantages thereof, while simultaneously overcoming some of the disadvantages normally associated therewith.

Still another object of the present invention is to provide a new prefabricated arch structure for aiding the construction of an archway.

Yet another object of the present invention is to provide a new prefabricated arch structure which includes a base wall with a pair of spaced apart side walls outwardly extending from the inner surface of the base wall. Each side wall is generally triangular and has a vertex corner, and a pair side edges extending from the vertex corner towards the ends of the base wall.

Still yet another object of the present invention is to provide a new prefabricated arch structure that helps reduce the amount of time and labor needed to install an arch, especially compared to traditional methods of making archways with drywalls.

Even still another object of the present invention is to provide a new prefabricated arch structure that includes a foamed insulation for sound proofing the structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
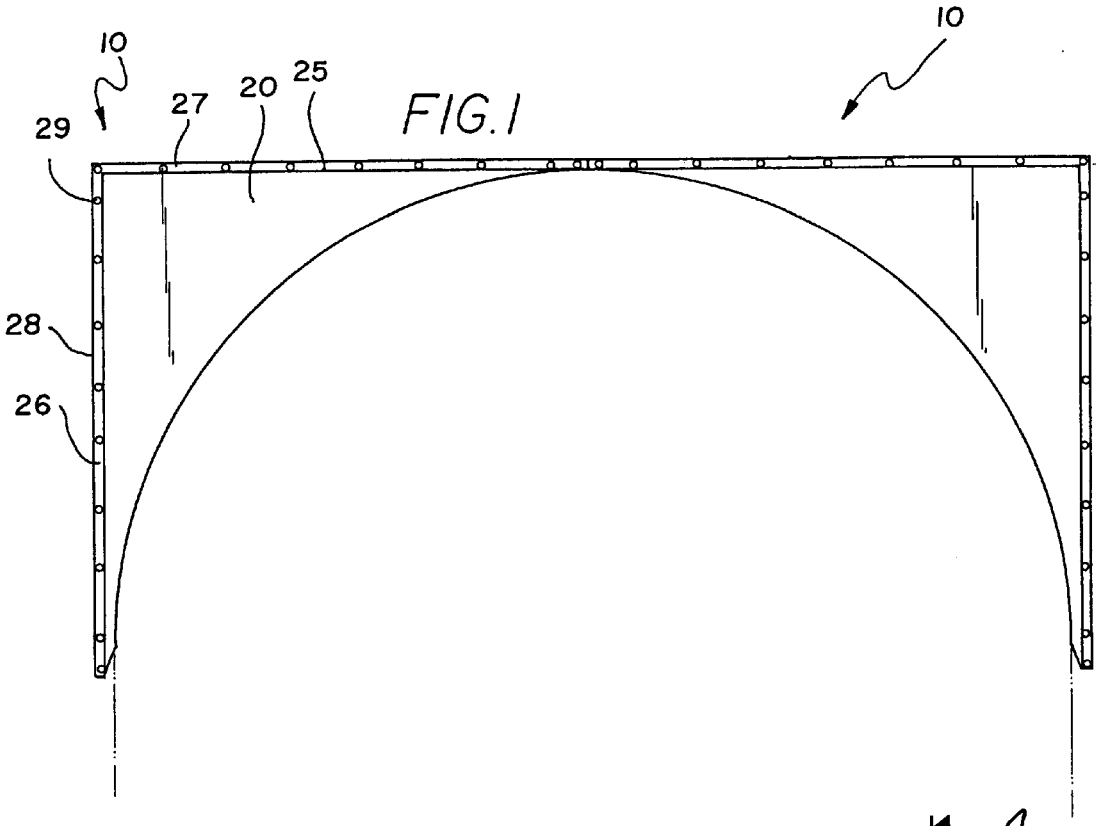
FIG. 1 is a schematic side view of a pair of new prefabricated arch structures in use according to the present invention.
Figure 2:
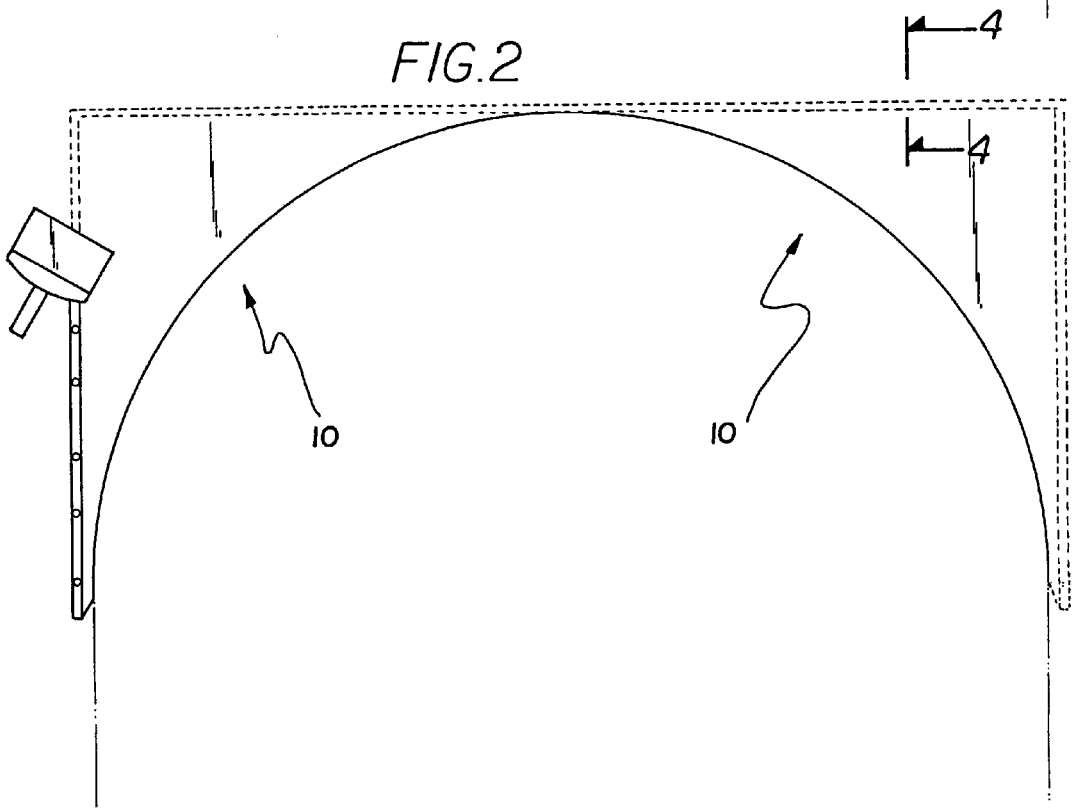
FIG. 2 is another schematic side view of the present invention in use.
Figure 3:
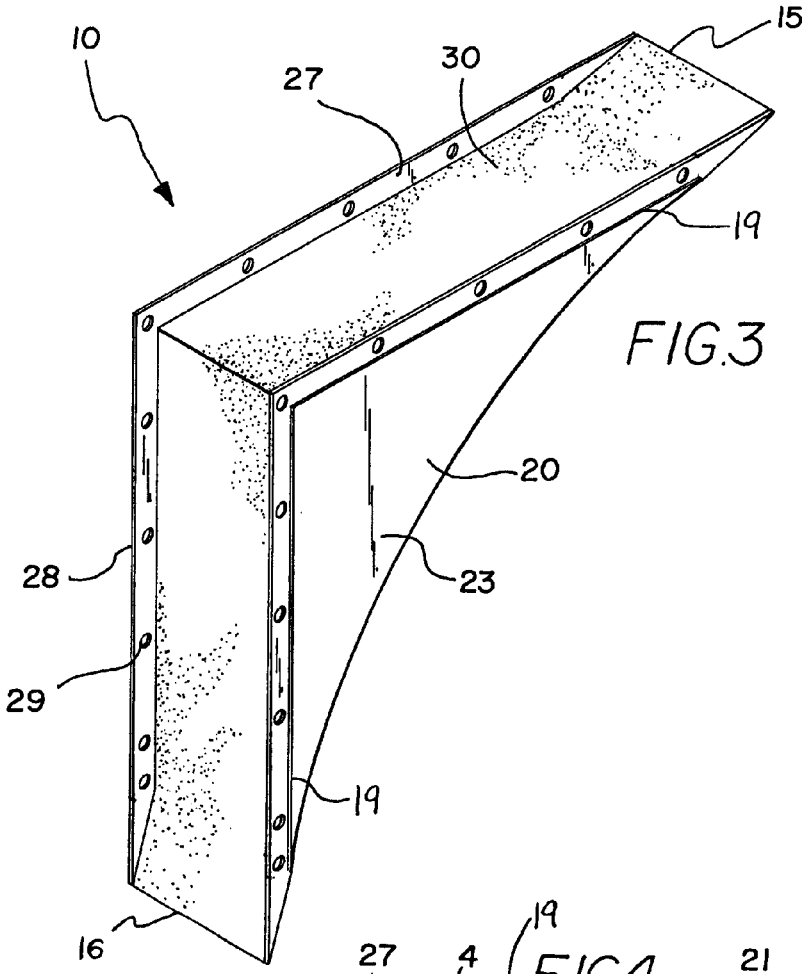
FIG. 3 is a schematic perspective view of the present invention.
Figure 4:
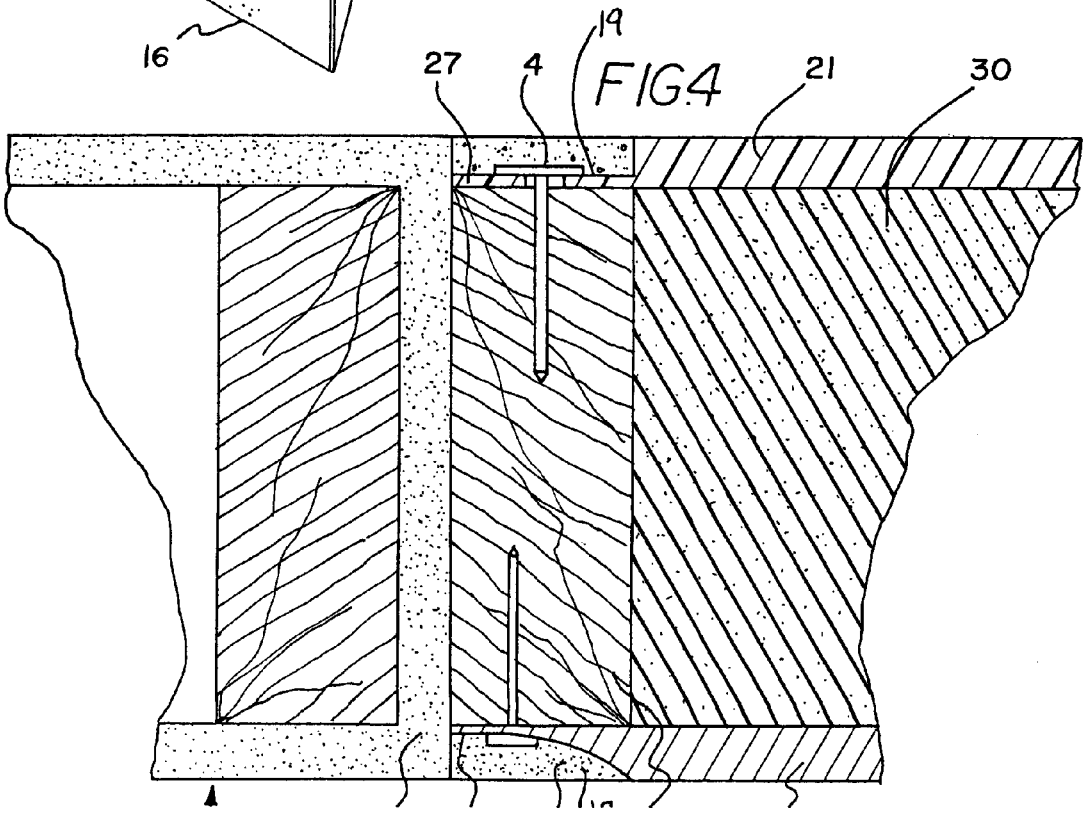
FIG. 4 is a schematic sectional view of the present invention taken from line 4—4 on FIG. 2.
Figure 5:
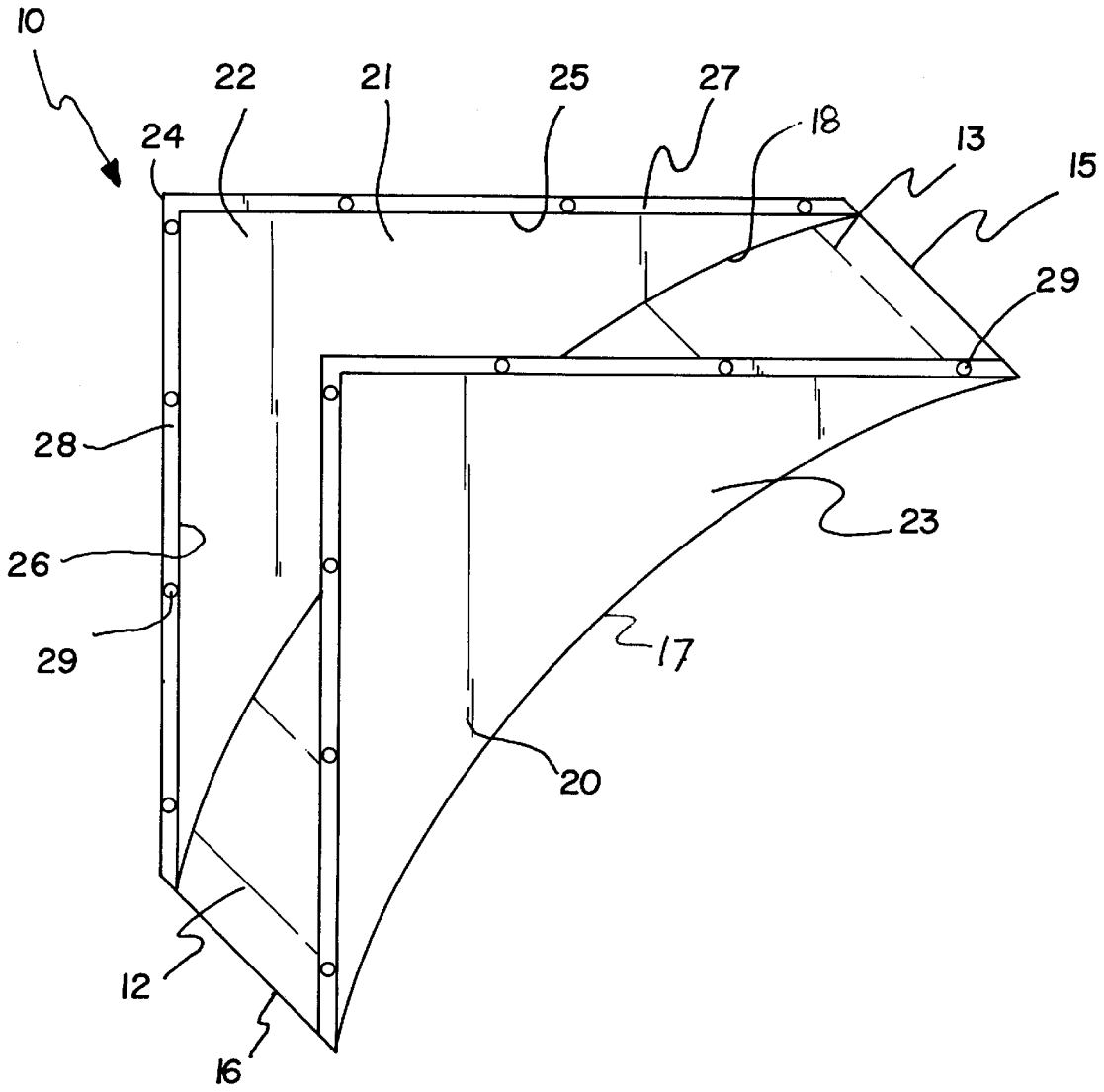
FIG. 5 is a schematic perspective view of the present invention without the material between the side walls.

With reference now to the drawings, and in particular to FIGS. 1 through 5 thereof, a new prefabricated arch structure embodying the principles and concepts of the present invention and generally designated by the reference numeral 10 will be described.

As best illustrated in FIGS. 1 through 5, the prefabricated arch structure 10 generally comprises a base wall 12 with a pair of spaced apart side walls 20,21 outwardly extending from the inner surface 13 of the base wall 12. Each side wall 20,21 is generally triangular and has a vertex corner 24, and a pair side edges 25,26 extending from the vertex corner 24 towards the ends of the base wall 12.

In use, the prefabricated arch structure 10 is designed for installation to a wall structure 1 especially one using drywall 2. In closer detail, the base wall 12 is generally arcuate and has inner and outer surfaces. Optionally, the base wall 12 may be generally straight to form another shape of arch. The base wall 12 also has a pair of opposite ends 15,16 and a pair of spaced apart generally arcuate sides (7,18) extending between the ends 15,16 of the base wall 12.

The pair of spaced apart side walls 20,21 are outwardly extended from the inner surface 13 of the base wall 12 with one of the side walls 20 extending from one of the sides (17) of the base wall 12 and the other side wall 21 extending from the other side (18) of the base wall 12. Preferably, each of the side walls 20,21 is extended from their associated sides of the base wall 12 such that the side walls 20,21 are generally parallel to one another and the side 17,18 walls 20,21 are generally perpendicular with the base wall 12.

Each side wall 20,21 is generally triangular and has inner and outer surfaces 22,23, a vertex corner 24, and a pair side edges 25,26. Each side edge 25,26 extends from the vertex corner 24 towards their associated end 15,16 of the base wall 12 so that, preferably, the side 17,18 edges extend substantially perpendicular to one another.

In the preferred embodiment, each of the sides edges 25,26 of each of the side walls 20,21 has an elongate mounting strip 27,28. The mounting strips 27,28 of each side edge extend between their associated vertex corner 24 and their associated end of the base wall 12. Each of the mounting strips has inner and outer surfaces. Ideally, the outer surface of each of the mounting strips is positioned between the inner and outer surfaces 22,23 of their associated side wall such that each mounting strip defines an offset (19). The offsets (19) are designed for accepting drywall mud 2 therein. Each of the mounting strips 27,28 has a plurality of spaced apart holes 29 extending between their inner and outer surfaces. The holes 29 are designed for inserting fasteners 4 therethrough for coupling the mounting strips to a wall structure 1. Preferably, a material 30 is provided in the space between the side walls 20,21. Ideally, the material substantially fills the space between the side walls 20,21 and comprises a foamed material. The material is designed for providing additional structural support to the prefabricated arch structure and additional insulation to the prefabricated arch structure.

In use, the arch structure 10 is fastened to the wall structure 1 or to an added support structure such as a two by four 3. A corresponding arch structure is similarly fastened to the wall structure 1 to form a complete arch. Drywall mud 2 may then be applied to fill the offsets and to finish the arch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A prefabricated arch structure for installation to a wall structure, said prefabricated arch structure comprising:

a base wall having inner and outer surfaces, a pair of opposite ends, and a pair of spaced apart sides, said sides of said base wall being extended between said ends of said base wall;

a pair of spaced apart side walls being outwardly extended from said inner surface of said base wall, one of said side walls being extended from one of said sides of said base wall, another of said side walls being extended from another of said sides of said base wall;

each side wall being generally triangular and having inner and outer surfaces, a vertex corner, and a pair of side edges, one of said side edges of said side wall being extended from said vertex corner towards one of said ends of said base wall, another of said side edges of said side wall being extended from said vertex corner towards another of said ends of said base wall; and wherein each of said side edges of each of said side walls has an elongate mounting strip, said mounting strips of each side edge being extended between their associated vertex corner and their associated end of said base wall, each of said mounting strips having inner and outer surfaces.

2. The prefabricated arch structure of claim 1, wherein said base wall is generally arcuate and said sides of said base wall are generally arcuate.

3. The prefabricated arch structure of claim 1, wherein said outer surface of each of said mounting strips are positioned between said inner and outer surfaces of their associated side wall such that each mounting strip defines an offset, said offsets being for accepting drywall mud therein.

4. The prefabricated arch structure of claim 1, wherein each of said mounting strips has a plurality of spaced apart holes extending therethrough.

5. The prefabricated arch structure of claim 1, further comprising a material being provided in a space between said side walls.

6. The prefabricated arch structure of claim 5, wherein said material substantially fills said space between said side walls.

7. The prefabricated arch structure of claim 5, wherein said material comprises a foamed material.

8. A prefabricated arch structure for installation to a wall structure, said prefabricated arch structure comprising:

a base wall being generally arcuate and having inner and outer surfaces, a pair of opposite ends, and a pair of spaced apart sides, said sides of said base wall being generally arcuate, said sides of said base wall being extended between said ends of said base wall;

a pair of spaced apart side walls being outwardly extended from said inner surface of said base wall, one of said side walls being extended from one of said sides of said base wall, another of said side walls being extended from another of said sides of said base wall;

each side wall being generally triangular and having inner and outer surfaces, a vertex corner, and a pair of side edges, one of said side edges of said side wall being extended from said vertex corner towards one of said ends of said base wall, another of said side edges of said side wall being extended from said vertex corner towards another of said ends of said base wall, said pair of side edges being extended substantially perpendicular to one another;

each of said sides edges of each of said side walls having an elongate mounting strip, said mounting strips of each side edge being extended between their associated vertex corner and their associated end of said base wall, each of said mounting strips having inner and outer surfaces, wherein said outer surface of each of said mounting strips being positioned between said inner and outer surfaces of their associated side wall such that each mounting strip defines an offset, said offsets being for accepting drywall mud therein;

each of said mounting strips having a plurality of spaced apart holes extending therethrough; and a material being provided in a space between said side walls, said material substantially filling said space between said side walls, wherein said material comprises a foamed material.

9. A prefabricated arch structure for installation to a wall structure, said prefabricated arch structure comprising:

a base wall having inner and outer surfaces, a pair of opposite ends, and a pair of spaced apart sides, said sides of said base wall being extended between said ends of said base wall;

a pair of spaced apart side walls being outwardly extended from said inner surface of said base wall, one of said side walls being extended from one of said sides of said base wall, another of said side walls being extended from another of said sides of said base wall;

each side wall being generally triangular and having inner and outer surfaces, a vertex corner, and a pair of side edges, one of said side edges of said side wall being extended from said vertex corner towards one of said ends of said base wall, another of said side edges of said side wall being extended from said vertex cornet towards another of said ends of said base wall; and a material being provided in a space between said side walls.

10. The prefabricated arch structure of claim 9, wherein said material substantially fills said space between said side walls.

11. The prefabricated arch structure of claim 9, wherein said material comprises a foamed material.

* * * * *